United States Patent [19]

Bowman

[11] 3,968,600

[45] July 13, 1976

[54] ADJUSTABLE MANHOLE COVER SUPPORT STRUCTURE

[75] Inventor: Harold M. Bowman, Bay Village, Ohio

[73] Assignee: National Utility Products Company, Cleveland, Ohio

[22] Filed: Aug. 5, 1974

[21] Appl. No.: 494,817

Related U.S. Application Data

[63] Continuation of Ser. No. 286,115, Sept. 5, 1972, abandoned.

[52] U.S. Cl. ..... 52/19; 404/26

[51] Int. Cl.[2] ..... E02D 29/14

[58] Field of Search ..... 52/19, 21; 404/25, 26

[56] References Cited

UNITED STATES PATENTS

| | | | |
|---|---|---|---|
| 1,639,495 | 8/1927 | Frane | 52/20 X |
| 2,346,361 | 4/1944 | Cupido | 52/21 |
| 3,408,778 | 11/1968 | Mason | 52/20 |

FOREIGN PATENTS OR APPLICATIONS

| | | | |
|---|---|---|---|
| 725,408 | 1/1966 | Canada | 52/20 |
| 1,102,946 | 2/1968 | United Kingdom | 52/21 |

*Primary Examiner*—Ernest R. Purser
*Assistant Examiner*—Carl D. Friedman
*Attorney, Agent, or Firm*—Baldwin, Egan, Walling & Fetzer

[57] ABSTRACT

An adjustable manhole cover support structure including a peripheral frame adapted for placement in the opening of a manhole housing, a peripheral manhole adjusting ring disposed on the frame, and a lateral support ring disposed on the adjusting ring. The adjusting ring has a peripheral inner seat for receiving the manhole cover. The lateral support ring retains the manhole cover in fixed horizontal position.

8 Claims, 5 Drawing Figures

ADJUSTABLE MANHOLE COVER SUPPORT STRUCTURE

This is a continuation patent application of pending United States patent application Ser. No. 286,115, now abandoned filed 9-5-72 in the name of Harold M. Bowman, and entitled "Adjustable Manhole Cover Support Structure."

This invention relates to manhole cover supports and more particularly to an adjustable support for varying the height of the cover and includes a lateral support ring to maintain the cover in fixed horizontal position.

In the repair and resurfacing of streets and highways, it is frequently found that the repaired or resurfaced roadway is substantially higher than the original roadway with the result that the upper edges of numerous manhole housings are disposed substantially below the new road surface. The upper end portions of the housings carry annular, inwardly projecting flanges just below the upper edges thereof for supporting manhole covers and such covers are disposed below the resurfaced roadway, thereby creating hazardous driving conditions unless some means is provided for raising the levels of the covers. Prior adjustable supports also lacked means for retaining the cover in fixed horizontal position.

An object of the invention is to provide a vertically adjustable manhole cover support whereby a manhole cover can be raised to the level of a newly resurfaced road.

Another object is to provide a manhole cover support of the above type having means for mounting it on a conventional manhole housing.

A further object of the invention is to provide a manhole cover support of the above type having means to prevent lateral movement of the cover.

A further object of the invention is to provide a manhole cover support of the above type that is simple in construction, inexpensive to manufacture, and highly effective in operation.

According to one modification of the invention, it is an object to provide a sectional manhole cover support for original installation which circumferentially engages a modified manhole housing in such manner as to be subsequently vertically adjustable when the street or highway is resurfaced.

Briefly, the foregoing objects are accomplished by the provision of a manhole cover support for vertically adjusting the level of an associated manhole cover in the opening of a manhole housing including a manhole frame adapted to be fixed in the opening, a unitary peripheral manhole adjusting ring disposed on the frame and having a peripheral seat formed in its interior peripheral surface for receiving the manhole cover, and a lateral support ring disposed on the adjusting ring to retain the cover in fixed horizontal position. Both rings may be formed of peripheral segments.

The lateral support ring may be formed of segments.

In another form of the invention, the adjusting ring has a peripheral groove formed in its upper outer edge portion and the support ring is disposed on the adjusting ring whereby the lower edge portion of the support ring is disposed in the groove.

Other objects and advantages of the invention will be apparent from the following description taken in conjunction with the drawings wherein.

In the drawings, like numbers refer to like parts.

Figure 1:
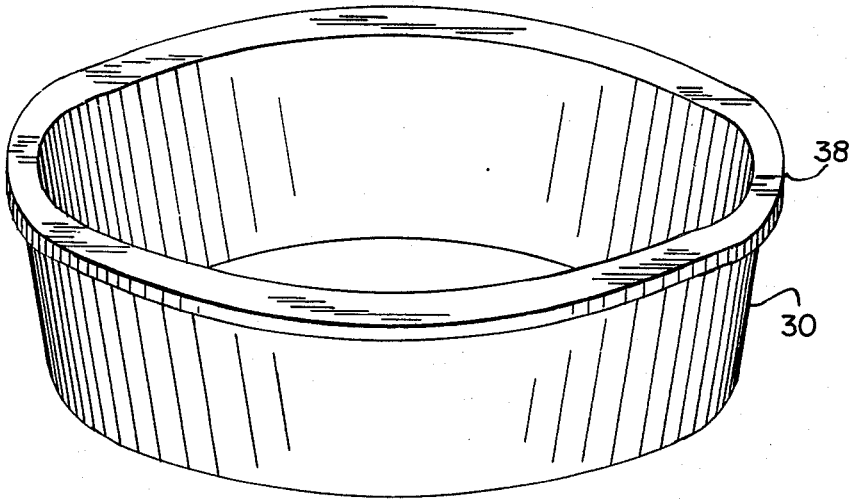
FIG. 1 is a perspective view of a lateral support ring of an adjustable manhole cover support structure of the invention.
Figure 2:
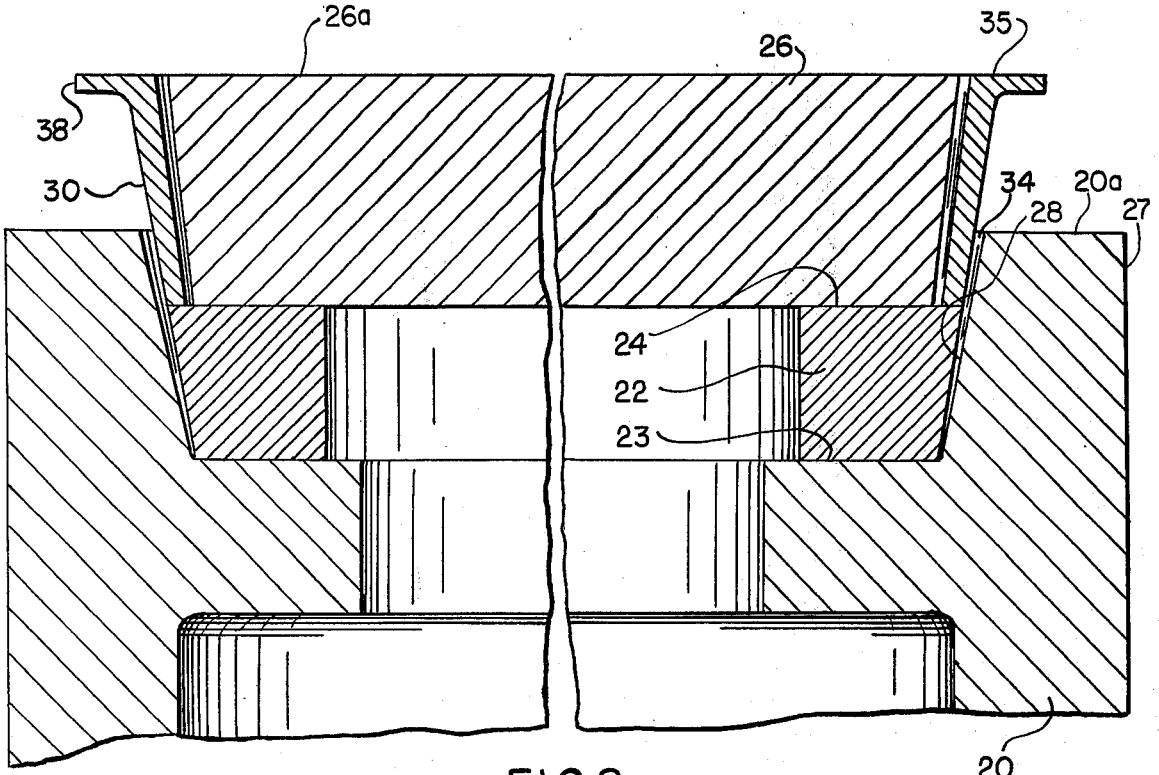
FIG. 2 is a vertical sectional view of an adjustable manhole cover support structure incorporating the support ring of FIG. 1.
Figure 5:
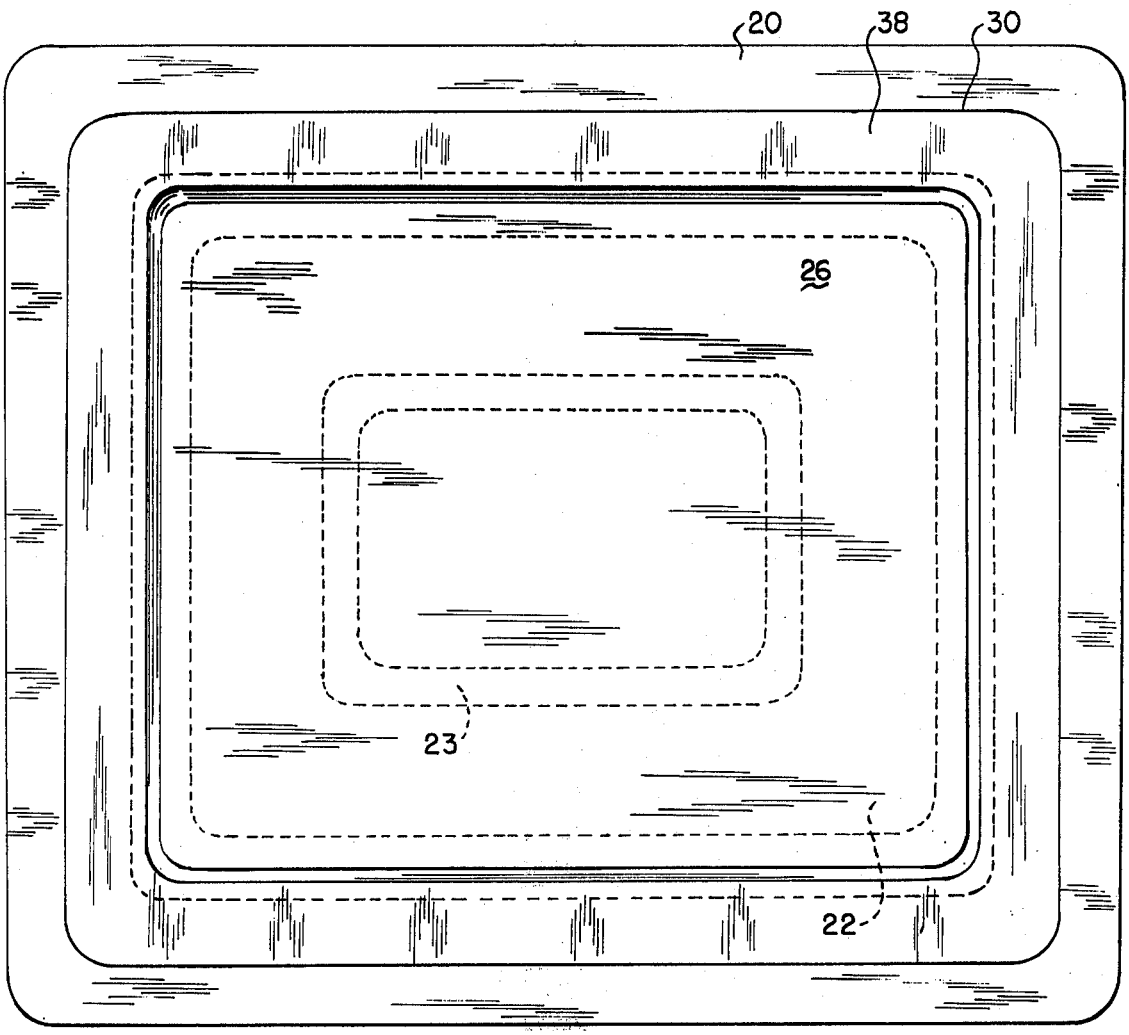
FIG. 5 is a plan view of a further modification of the adjustable manhole cover support structure, with the latter being of rectangular configuration.

Referring first to FIGS. 1 and 2, there is shown a manhole cover support including a manhole frame 20, and a unitary peripheral manhole adjusting ring 22 disposed on the frame seat or shoulder 23 and having a seat 24 formed on its upper surface for receiving a manhole cover 26 thereon. Frame 20 includes an upwardly projecting collar-like portion 27 generally circumscribing seat or shoulder 23 and defining the manhole opening in frame 20.

Normally, the manhole cover 26 rests on the frame seat or shoulder 23 and substantially completely fills the manhole opening in frame 20, except for predetermined generally unobstructed clearance conventionally provided between the cover 26 and the confronting interior surface 28 of the collar portion 27. When the street is paved and the pavement thus raised, the manhole cover is raised by placing the adjusting ring 22 on the seat 23 and then placing the cover 26 on the ring 22.

To prevent lateral movement of the cover 26, a lateral support ring 30 is provided. More specifically, the invention provides a manhole cover support structure for vertically adjusting the level of an associated manhole cover 26 in the opening of a manhole housing including a manhole frame 20 adapted to be fixed in the opening, a peripheral manhole adjusting ring 22 disposed on the frame 20 and having a peripheral upper seat 24 formed on its top surface for receving the manhole cover 26. The manhole cover 26 is spaced slightly inwardly of the frame 20 to form a peripheral space 34 between the manhole cover 26 and the frame 20. The lateral support ring 30 is disposed in such peripheral space 34 to retain the manhole cover 26 in fixed horizontal position. In the adjusted, elevated condition of the cover relative to shoulder 23 of the frame, the top surface 26a of the cover and the top surface 35 of the ring 30 are preferably at substantially the same level, with surface 35 being disposed in elevated condition with respect to top surface 20a of frame 20, and as shown in FIGS. 2 and 4.

Figure 3:
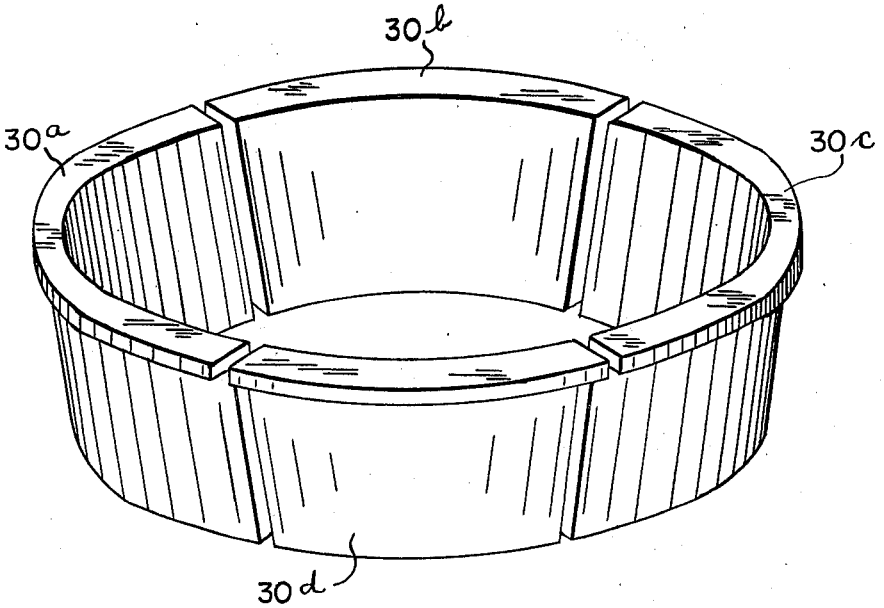
FIG. 3 illustrates a modification of the support ring of FIG. 1.

In a modification of the invention, the support ring may be segmented, whereby such ring is formed of peripheral segments 30a, 30b, 30c and 30d as shown in FIG. 3.

Figure 4:
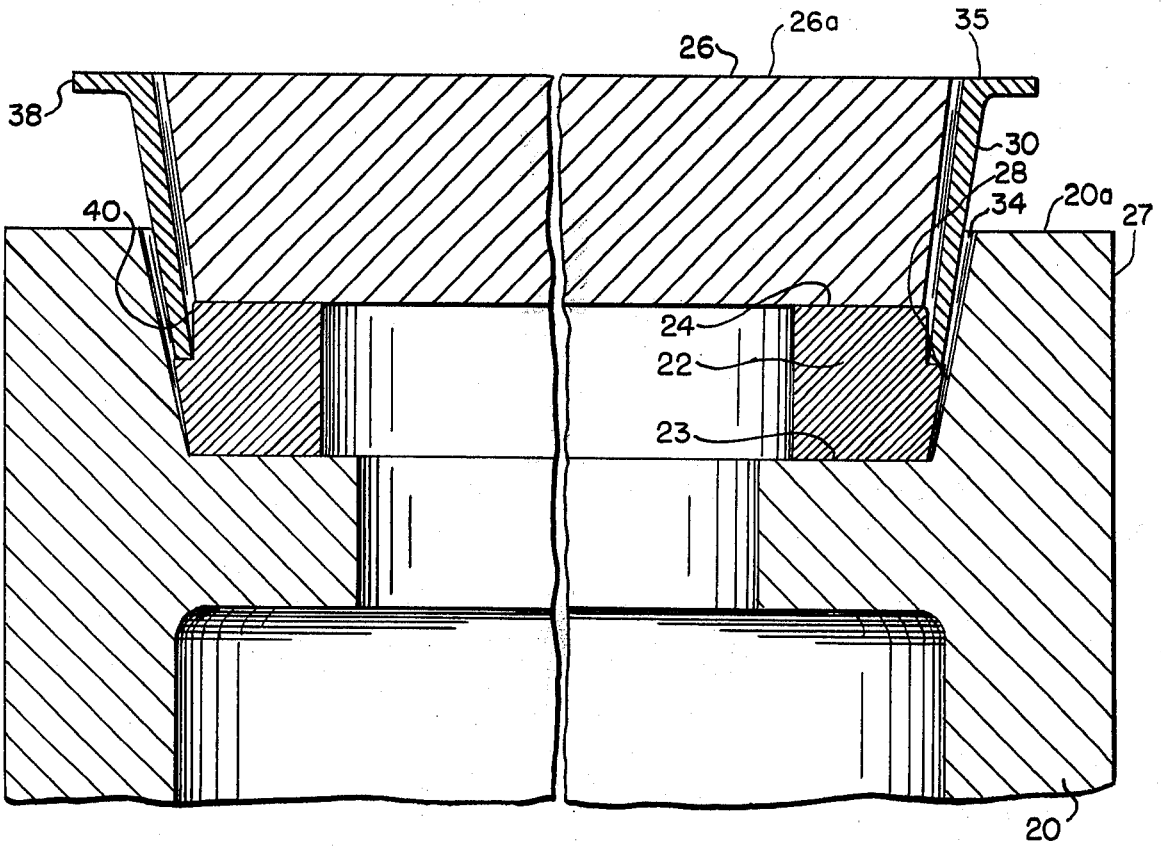
FIG. 4 is similar to FIG. 2, but illustrates a modification thereof.

The lateral support ring 30 has a flange 38 extending outwardly from its upper edge, whereby such lateral support ring is of inverted L-shape in transverse section as best shown in FIGS. 2 and 4, such shape providing increased load bearing strength.

It will be understood that the frame, cover and rings aforedescribed may be rectangular in plan view.

In a further modification as shown in FIG. 4, the adjusting ring 22 may have a peripheral groove 40 formed in the upper outer edge portion thereof and the lateral support ring 30 is disposed on the adjusting ring 22 such that the lower edge portion of the support ring 30 is disposed in the groove 40.

Thus there is provided a manhole height adjusting means of simple, economical construction that may be very easily operated by the man in the field.

With the lateral support ring 30, the manhole cover 26 is permanently affixed in hoizontal position.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A manhole cover support structure to vertically adjust and support a manhole cover in a manhole frame, wherein the manhole frame is supported in a manhole housing and has an upwardly facing shoulder circumscribed by an upwardly projecting collar-like portion defining the manhole opening, a manhole cover normally engaged with and supported on said shoulder, with said cover substantially completely filling said opening, except for predetermined generally unobstructed lateral clearance between said cover and the confronting interior surface of said collar-like portion, a cover adjusting insert resting on said shoulder and having an upper cover supporting surface on which said cover rests in adjusted, elevated position relative to the shoulder of said frame, the outer peripheral edge of said cover spaced laterally from said interior surface of said collar-like portion in said adjusted, elevated position of said cover, and a separate relatively thin lateral support ring resting on said cover support insert and disposed in the last mentioned lateral space between said interior surface of said collar-like portion and said outer edge of said cover, to restrain against lateral movement relative to the frame, the full weight of said cover being supported directly by said cover adjusting insert in said adjusted elevated position of said cover, and wherein said interior surface of said collar-like portion of said frame slopes downwardly and inwardly terminating at its lower edge at the outer periphery of said shoulder, said collar-like portion having a substantially horizontal top surface, said adjusting insert having an outer side surface which tapers inwardly in a downward direction and which last mentioned side surface is disposed in confronting generally closely spaced relation to said interior surface, and said support ring including a defining wall structure which on its outer side surface is tapered inwardly in a downward direction and generally complementary to the taper on said outer side surface of said adjusting insert, said support ring having an inner downwardly and inwardly sloped defining side surface, and said cover comprising an outer defining side surface which is sloped generally complementary to said sloped inner defining side surface of said support ring, said cover and ring confronting side surfaces being disposed in generally laterally spaced relation to one another, and with the top surfaces of said cover and said support ring being disposed at substantially the same elevation and with said top surface of said support ring being disposed in elevated condition relative to said top surface of said collar-like portion.

2. A support structure in accordance with claim 1 wherein said lateral support ring is segmented, and the upper edge of each ring segment includes a laterally outwardly extending flange portion adapted for engagement with an adjacent surface to increase the load bearing strength of said support ring.

3. A support structure in accordance with claim 1 wherein said frame, shoulder, cover and ring are rectangular in plan view.

4. A support structure in accordance with claim 1 wherein said adjusting insert has a peripheral groove formed in the upper outer edge portion thereof, and said support ring has its lower edge portion disposed in said groove.

5. A support structure in accordance with claim 1 wherein said support ring includes a laterally outwardly projecting flange portion disposed at the upper edge of said defining wall structure thereof, the top surface of said flange portion being generally coplanar with said top surface of said cover, in said adjusted elevated position of said cover.

6. A support structure in accordance with claim 1 wherein said adjusting insert above said tapered outer side surface thereof has means overlapping in a vertical direction the lower end portion of said support ring and coacting with the latter in lateral directions for positioning said support ring relative to said adjusting insert, and wherein the upper edge of said support ring has a laterally outwardly extended flange thereon for engagement with an adjacent surface to increase the load bearing strength of said support ring.

7. A manhole cover support structure to vertically and horizontally support a manhole cover in a manhole frame in vertically adjusted position relative to the frame, wherein the manhole frame comprises an upwardly projecting collar-like portion defining the manhole opening with said collar-like portion having an inner, peripheral, downwardly and inwardly tapered frusto-conically shaped wall surface terminating at its lower edge in an upwardly facing shoulder on which a manhole cover is normally engaged and supported, with said cover substantially completely filling said opening except for predetermined generally unobstructed lateral clearance between said cover and the confronting said inner surface of said collar-like portion, a cover support ring resting on the said shoulder and having an upper cover supporting surface on which said cover rests in vertically adjusted, elevated position relative to said shoulder of said frame, the outer peripheral edge of said cover being spaced from said inner surface in said adjusted, elevated position of said cover, said cover support ring having a peripheral groove in the upper outer edge portion thereof, and a separate relatively thin lateral support ring resting at its lower edge thereof in said peripheral groove and extending upwardly in the space between said inner surface of said frame and said outer edge of said cover to restrain the cover against lateral movement relative to the frame, the full weight of said cover being supported directly by said cover support ring in said adjusted elevated position of said cover, and said cover having a top surface which is disposed substantially coplanar with the top surface of said lateral support ring in said adjusted elevated position of said cover, said collar-like portion having a substantially horizontal top surface, and with said top surfaces of said cover and said lateral support ring being disposed at an elevation above said top surface of said collar-like portion in said adjusted position of said cover.

8. A support structure in accordance with claim 1 wherein said support ring is segmented, with each segment at its upper edge including a laterally outwardly projecting flange portion adapted for engagement with an adjacent surface.

* * * * *

PO-1050
(5/69)

UNITED STATES PATENT OFFICE
CERTIFICATE OF CORRECTION

Patent No. 3,968,600 Dated July 13, 1976

Inventor(s) Harold M. Bowman

It is certified that error appears in the above-identified patent and that said Letters Patent are hereby corrected as shown below:

Column 3, line 37, after "restrain", insert --the cover--.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*